US010625889B2

(12) United States Patent
Duchstein

(10) Patent No.: US 10,625,889 B2
(45) **Date of Patent: *Apr. 21, 2020**

(54) DEVICE FOR FILLING A THIN-WALLED TRANSPORT CONTAINER WITH NOTES OF VALUE

(71) Applicant: Wincor Nixdorf International GmbH, Paderborn (DE)

(72) Inventor: Mirko Duchstein, Berlin (DE)

(73) Assignee: Wincor Nixdorf International, GmbH, Paderborn (DE)

( * ) Notice: Subject to any disclaimer, the term of this patent is extended or adjusted under 35 U.S.C. 154(b) by 298 days.

This patent is subject to a terminal disclaimer.

(21) Appl. No.: 15/695,687

(22) Filed: Sep. 5, 2017

(65) Prior Publication Data

US 2018/0037350 A1 Feb. 8, 2018

Related U.S. Application Data

(63) Continuation of application No. 14/154,553, filed on Jan. 14, 2014, now Pat. No. 9,751,651.

(30) Foreign Application Priority Data

Jan. 16, 2013 (EP) ..... 13151453

(51) Int. Cl.
*B65B 5/10* (2006.01)
*B65B 7/02* (2006.01)
(Continued)

(52) U.S. Cl.
CPC ..... *B65B 35/50* (2013.01); *B65H 29/46* (2013.01); *B65H 31/06* (2013.01); *B65H 43/06* (2013.01);
(Continued)

(58) Field of Classification Search
CPC .... B65B 5/00; B65B 5/10; B65B 7/00; B65B 7/16; B65B 61/20; B65B 5/101;
(Continued)

(56) References Cited

U.S. PATENT DOCUMENTS 4,045,017 A * 8/1977 Lundblad ..... B65H 31/06 271/181
5,715,923 A * 2/1998 Dekker ..... G07F 7/04 194/206

(Continued)

*Primary Examiner* — Praachi M Pathak
(74) *Attorney, Agent, or Firm* — Black, McCuskey, Souers & Arbaugh, LPA

(57) ABSTRACT

A device (10) for filling a thin-walled transport container (18) made of flexible material with notes of value is described. For this, the device (10) comprises a supply unit (12), a stacking unit (14) and a receiving unit (16) for receiving the thin-walled transport container (18). By means of a stuffing unit (20) the stacked notes of value are moved into the transport container (18) in several successive filling steps. A closing unit (22) closes the thin-walled transport container (18) after the last filling step. The receiving unit (16) comprises a contact sensor (32) which, upon contact with the bottom of the transport container (18), generates a signal that triggers the closing operation or the transport container (18).

18 Claims, 5 Drawing Sheets

(51) Int. Cl.

| | |
|---|---|
| ***B65B 7/06*** | (2006.01) |
| ***B65B 25/14*** | (2006.01) |
| ***B65B 35/50*** | (2006.01) |
| ***B65B 43/54*** | (2006.01) |
| ***G07D 11/12*** | (2019.01) |
| ***G07D 11/16*** | (2019.01) |
| ***G07D 11/40*** | (2019.01) |
| ***G07D 11/50*** | (2019.01) |
| ***B65H 29/46*** | (2006.01) |
| ***B65H 31/06*** | (2006.01) |
| ***B65H 43/06*** | (2006.01) |

(52) U.S. Cl.
CPC .. *B65H 2405/311* (2013.01); *B65H 2701/182* (2013.01); *B65H 2701/1912* (2013.01)

(58) Field of Classification Search
CPC .. B65B 5/106; B65B 7/02; B65B 7/06; B65B 25/14; B65B 35/50; B65B 43/54; B65H 43/06; G07D 11/009; G07D 11/0096; G07D 11/12; G07D 11/125; G07D 11/16; G07D 11/40; G07D 11/50
USPC .... 53/55, 505, 67, 531, 266.1, 75, 540, 567, 53/576, 284.7; 194/350
See application file for complete search history.

(56) References Cited

U.S. PATENT DOCUMENTS

| | | | | |
|---|---|---|---|---|
| 9,096,404 | B2 * | 8/2015 | Duchstein | B65B 5/106 |
| 9,114,952 | B2 * | 8/2015 | Holland-Letz | B65B 5/108 |
| 9,117,323 | B2 * | 8/2015 | Brexel | B65B 9/15 |
| 9,388,624 | B2 * | 7/2016 | Geesmeier | G07D 11/13 |
| 2011/0052363 | A1 * | 3/2011 | Brexel | B65B 9/15 414/798.2 |
| 2012/0067011 | A1 * | 3/2012 | Holland-Letz | B65B 5/108 53/542 |
| 2012/0167529 | A1 * | 7/2012 | Langhuber | B65B 11/08 53/467 |
| 2013/0138242 | A1 * | 5/2013 | Kallin | G07F 7/04 700/230 |
| 2014/0196416 | A1 * | 7/2014 | Duchstein | B65H 29/46 53/540 |
| 2014/0250837 | A1 * | 9/2014 | Duchstein | B65B 25/14 53/447 |
| 2014/0331612 | A1 * | 11/2014 | Jeschke | B65H 31/309 53/447 |

* cited by examiner

DEVICE FOR FILLING A THIN-WALLED TRANSPORT CONTAINER WITH NOTES OF VALUE

BACKGROUND OF THE INVENTION

Technical Field

The invention relates to a device for filling a thin-walled transport container made of flexible material with notes of value.

Discussion

Such a device often comprises a supply unit for supplying the notes of value, a stacking unit for stacking the supplied notes of value, a stuffing unit for transporting the stacked notes of value into the transport container in several successive filling steps, and a closing unit for closing the transport container. Notes of value are sheet-shaped documents of value, in particular banknotes, checks, coupons, vouchers or the like.

Such a device is used, for example, in automated teller machines, in particular cash deposit machines, and automatic cash safes, into which notes of value, in particular banknotes are deposited. The input notes of value are stacked in an unsorted manner or in a manner so as to be sorted according to at least one criteria and are subsequently placed in thin-walled transport containers. After filling with the notes of value, the transport containers are closed preferably in a revision-proof manner. The closed transport containers are usually removed from the automated teller machine or the cash safe by a cash/valuables-in-transit company.

From DE 10 2009 015 047 A1 a device for supplying notes or value into a flexible transport container is known. The supplied notes of value are stacked in a stacking unit, are transported into the transport container by means of a stuffing unit in several successive filling steps, and the transport container is closed thereafter.

Further, the documents WO 2009/138497 A1, WO 02/19289 A2, DE 10 2009 053 155 A1 and DE 10 2011 000 790 A1 each describe a device to which notes of value are suppliable and from which the supplied notes of value can be removed stacked in a transport container.

SUMMARY OF THE INVENTION

It is an object of the invention to specify a device for filling a thin-walled transport container with notes of value, in which it can easily be determined when the thin-walled transport container is completely filled.

The notes of value are fed into the thin-walled transport container in stacks of one or more notes of value such that, upon insertion into the entry area of the transport container, they are arranged in she container cross-section, and the note of value that is first supplied to the transport container in the first filling step lies flat against the bottom of the transport container. Each following filling step, in which further notes of value are fed to the transport container, increases the entire value note stack in the transport container. Here, the stuffing unit places the uppermost note of value or the value note stack supplied in the respective filling step at a same position for each filling step, as a result whereof the value note stack in the transport container moves the bottom of the transport container deeper and deeper into a receiving unit for receiving the transport container. The receiving unit comprises a contact sensor which, upon contact with the bottom of the transport container, generates a signal. A closing unit then closes the transport container dependent on this signal.

Preferably, the thin-walled transport container is made of a limp material, for example foil material. A transport container made of this material adapts particularly well to the value note stack contained therein and is closeable in a revision-proof manner by simple measures, such as welding or bonding.

In an advantageous embodiment, the contact sensor comprises a rod which is rotatably mounted about its longitudinal axis. The rod has a first rotary position in which the contact sensor generates no signal and a second rotary position in which the contact sensor generates a signal. When the contact sensor comes into contact with the bottom of the transport container, then the rod rotates from the first rotary position into the second rotary position. The position of the bottom of the transport container within the receiving unit is a suitable parameter for determining the filling level of the transport container with notes of value because the note of value that is first supplied to the transport container always bears against the bottom of the transport container. In the subsequent filling steps, the note of value that has been supplied first is moved further by the stuffing unit.

In preferred embodiments, the rod has a contact tab on its first rod end, which contact tab, upon contact with the transport container, rotates the rod from the first into the second rotary position. Further, at its second end the rod has a switching flag which triggers the signal generation in the second rotary position. This happens, for example, in that the switching flag interrupts the light beam of a light barrier in the second rotary position.

In a development of the invention, a torsion spring is provided which rotates the rod into the first rotary position and against the resistance of which the rod is rotatable into the second rotary position. In this way, it is on the one hand effectively prevented that the signal for closing the transport container is triggered early. On the other hand, after removal of the closed transport container from the receiving unit, the rod is again automatically rotated into the first rotary position.

It is advantageous when the transport container, after signal generation, is filled with notes of value for the last time in a final filling step and only afterwards the closing unit closes the transport container. In this way, it is possible for the stuffing unit to move the value note stack supplied in the final filling step up to a position such that the closing unit can easily and reliably close the transport container.

BRIEF DESCRIPTION OF THE DRAWINGS

The invention will be explained in the following on the basis of an embodiment with reference to the figures, in which.

DESCRIPTION OF THE PREFERRED EMBODIMENTS

Figure 1:
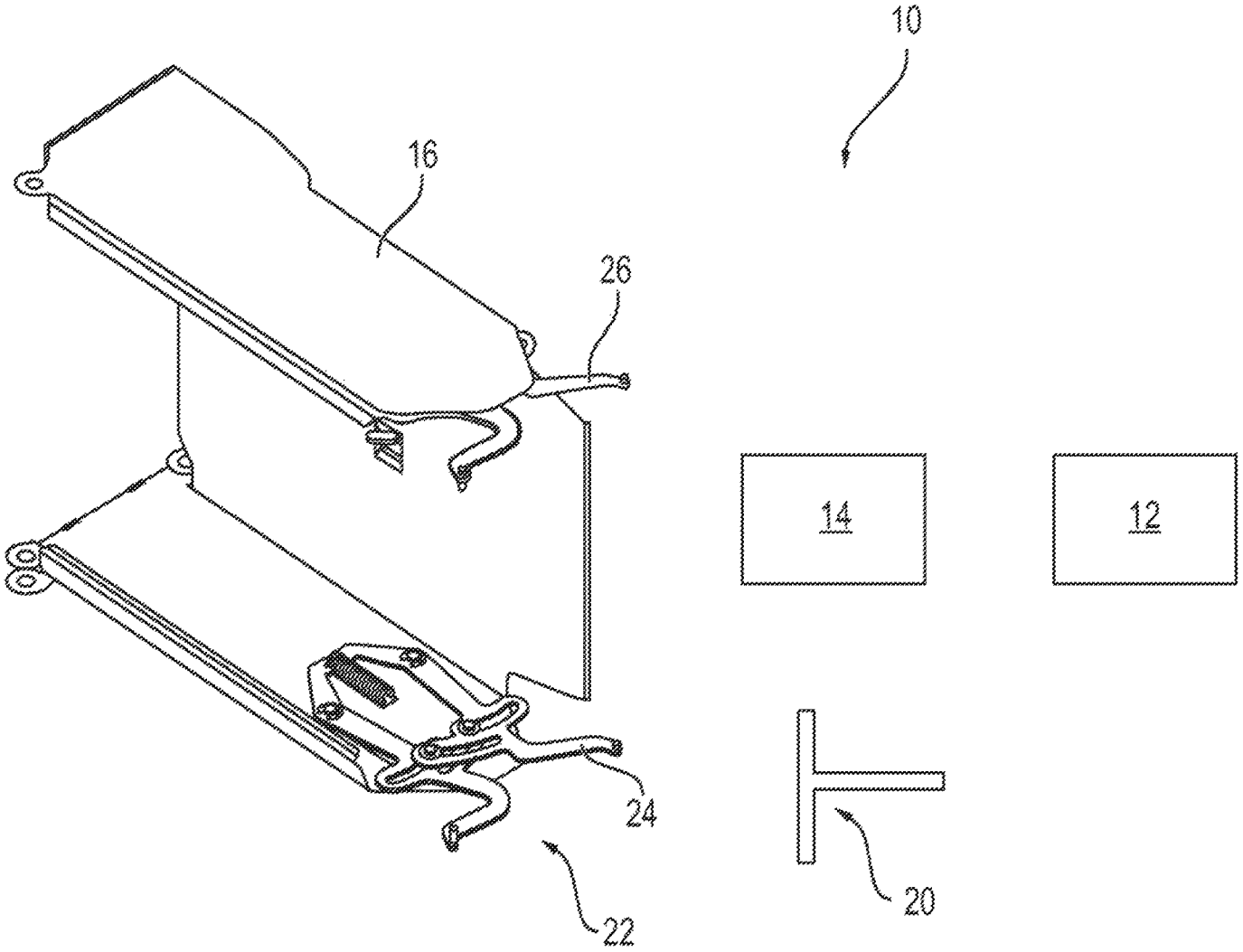
FIG. 1 shows a schematic perspective illustration of a device for filling a thin-walled transport container with notes or value.

FIG. 1 shows a schematic perspective illustration of a device 10 for filling a thin-walled transport container 18 (shown in FIG. 2) with notes of value. The device 10 comprises a supply unit 12 (only schematically illustrated) by means of which notes of value can be supplied to the device 10 by a user. The supply unit 12 known per se takes care of all actions that are to be carried out prior to a deposit of the notes of value. These are, for example, an authentication of the note or value, a sorting of the supplied notes of value according to at least one sorting criteria, the return of invalid notes of value to the user and/or the return of notes of value that have been supplied erroneously.

Notes of value to be deposited are transferred from the supply unit 12 to a stacking unit 14 known per se from the prior art. If the notes of value are sorted in the supply unit 12, then preferably for each sorting criteria one own stacking unit 14 is provided to which only notes of value are supplied that meet the respective sorting criteria. The stacking unit 14 stacks the supplied notes of value to value note stacks, i.e., the value note stack of the respective notes of value are oriented such that the facing surfaces of successive notes of value are in flat contact with each other and edges of approximately identical length are arranged approximately parallel to each other each time.

Figure 2:
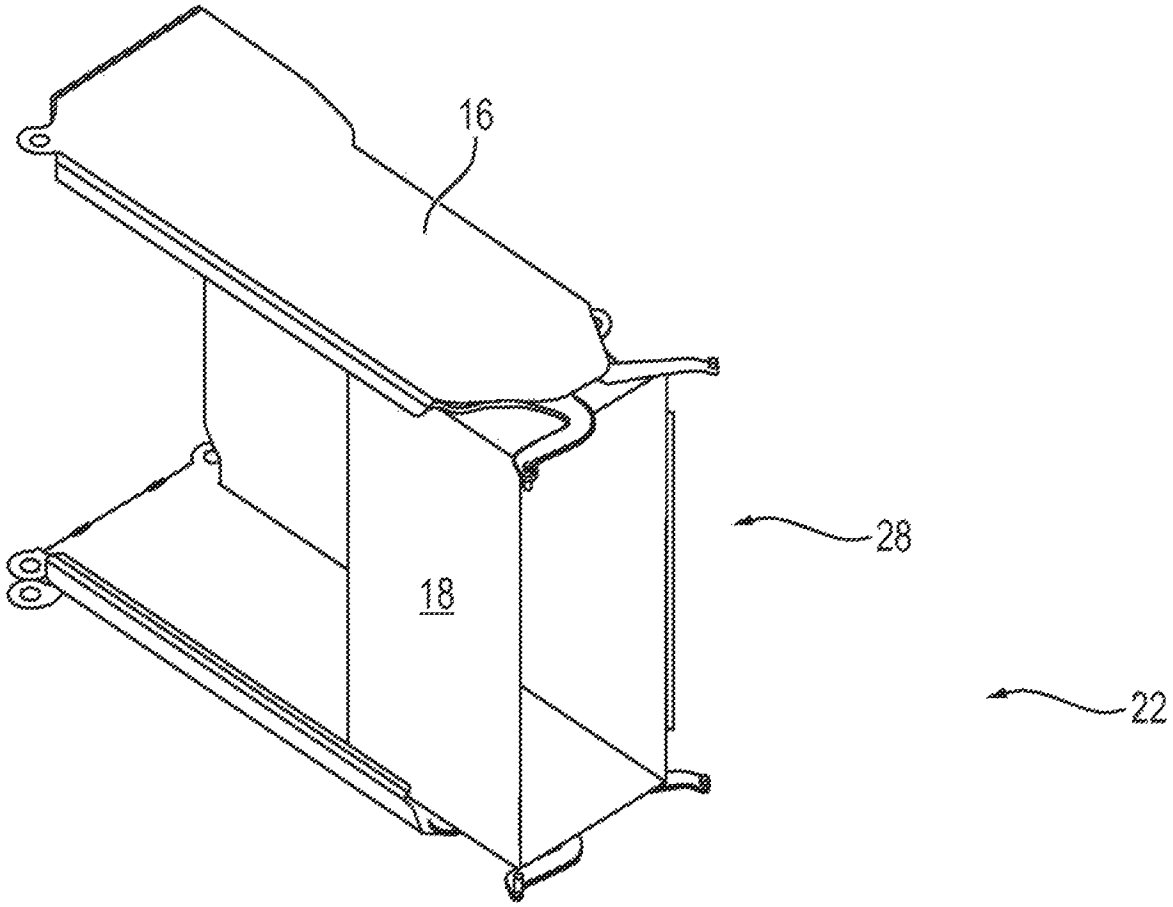
FIG. 2 shows a receiving unit and a closing unit according to FIG. 1 with a thin-walled transport container.

Further, the device 10 comprises a receiving unit 16 for receiving the thin-walled transport container 18 illustrated in FIG. 2, a T-shaped stuffing unit 20 (illustrated in FIG. 1 on a smaller scale) for moving the value note stacks produced in the stacking unit 14 into the transport container 18, and a closing unit 22 for closing the transport container 18 preferably in a revision-proof manner. Here, the closing unit 22 comprises a first subunit 24 and a second subunit 26 which cooperate for closing the transport container 18.

FIG. 2 shows the receiving unit 16 and the closing unit 22 according to FIG. 1 with the thin-walled transport container 18 made or limp material, preferably plastic foil. The transport container 18 is arranged in the receiving unit 16 such that its single opening 28 is oriented towards the stacking unit 14. During a filling step, the stuffing unit 20 moves the notes of value stacked in the stacking unit 14 into the transport container 18. Here, the value note stack is oriented such that the notes of value with their surface are oriented approximately parallel to the bottom of the transport container 18 that is opposite to the opening 28. This results in that the supplied value note stack is oriented so as to fit to a value note stack that has been transported into the transport container 18 during the preceding filling step and increases the stacking height of all notes of value in the transport container, i.e. the distance between the bottom of the transport container 18 and the note of value that has been last supplied to the transport container 18. Thus, during a filling step, both the value note stack already present in the transport container 18 and the value note stack supplied from the stacking unit 14 are moved, i.e. they experience a change of location relative to the opening 28. In particular, both value note stacks are moved deeper into the transport container 18.

Figure 3:
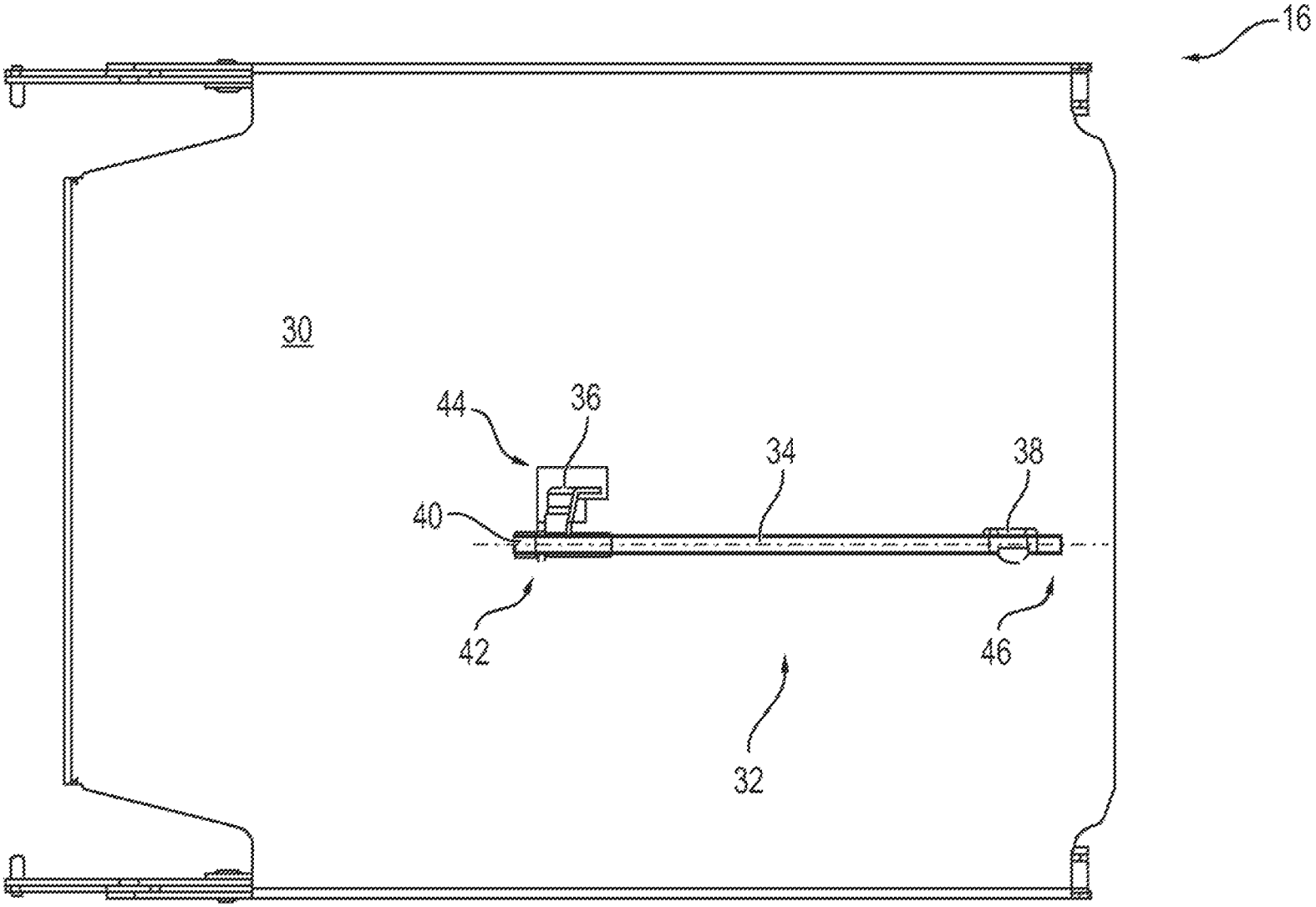
FIG. 3 shows a schematic view of a rear of the receiving unit and of the closing unit according to FIG. 1.

FIG. 3 shows a schematic view of a rear 30 of the receiving unit 16. Upon contact with the bottom of the transport container 18, a contact sensor 32 arranged on the rear 30 triggers a signal for closing the transport container 18. The contact sensor 32 comprises a rod 34, a contact tab 36, a switching flag 38, and a torsion spring 40. The contact tab 36 arranged near a first rod end 42 of the rod 34 projects through a recess 44 into the inside of the receiving unit 16. When, during a filling step, the value note stack present in the transport container 18 is moved into the receiving unit 16 so deep that the stack presses the bottom of the transport container 18 against the contact tab 36, then the contact tab 36 is rotated out of the interior of the receiving unit 16 and thus also the rod 34 that is connected to the contact tab 36 in a rotationally fixed manner is rotated.

Near the second rod end 46 that is opposite to the first rod end 42, the switching flag 38 is connected to the rod 34 in a rotationally fixed manner. Thus, a rotation of the rod 34 causes a rotation of the switching flag 38 from a first into a second rotary position. In the second rotary position, the switching flag 38 triggers a contact 48 that generates a signal, upon which the closing unit 22 closes the thin-walled transport container 18 preferably in a revision-proof manner. The contact 48 is, for example, a light barrier, the light beam of which is interrupted by the switching flag 38.

One end of the torsion spring 40 is connected to the rear 30 and the other end thereof is connected to the contact tab 36 and is biased such that it exerts a torque on the rod 34 which rotates the rod 34 into the first rotary position. The torque is chosen such that the rod 34 is rotatable into the second rotary position against this torque when the transport container 18 and the contact tab 36 come into contact.

Figure 4:
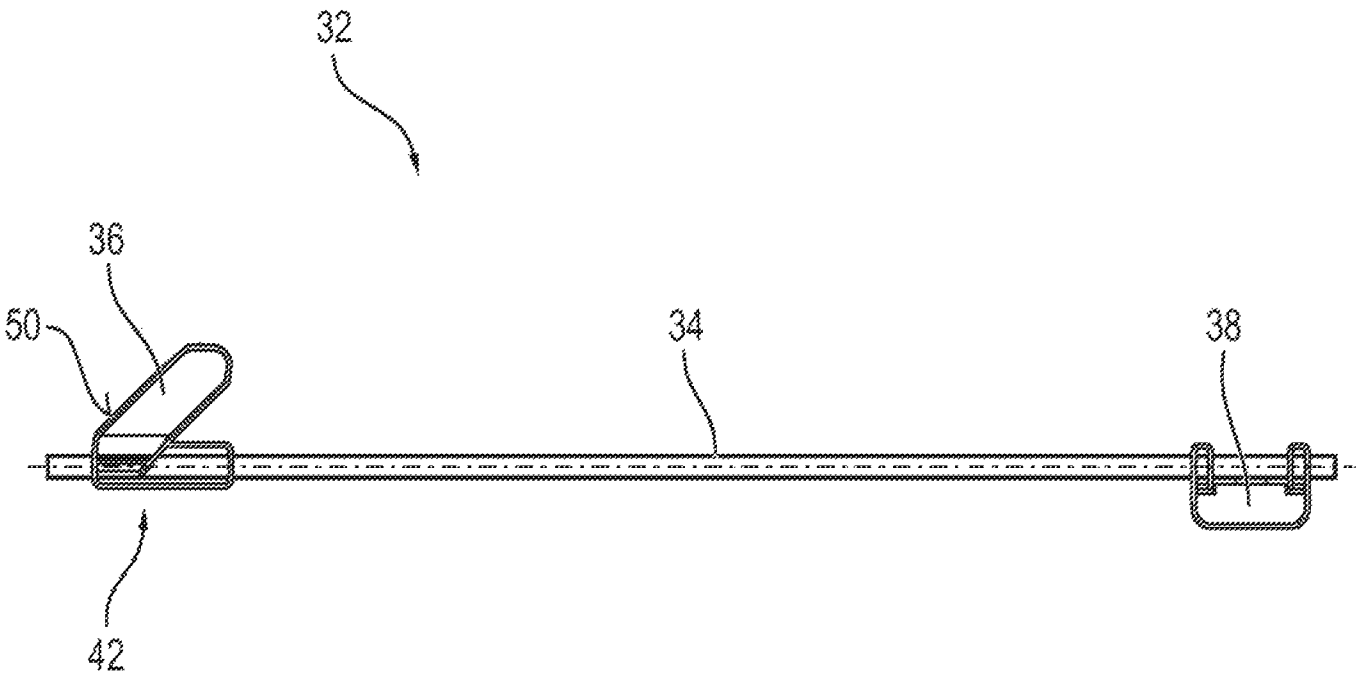
FIG. 4 shows a schematic illustration of a rod of a contact sensor.

FIG. 4 shows a schematic illustration of the rod 34 of the contact sensor 32. At the contact tab 36 a contact surface 50 is formed at the side facing the first rod end 42, which contact surface is rotated by the bottom of the transport container 18. The contact surface 50 is inclined relative to the longitudinal axis of the rod 34 so that a linear movement of the transport container 18 is converted into a rotary motion of the rod 34.

Figure 5:
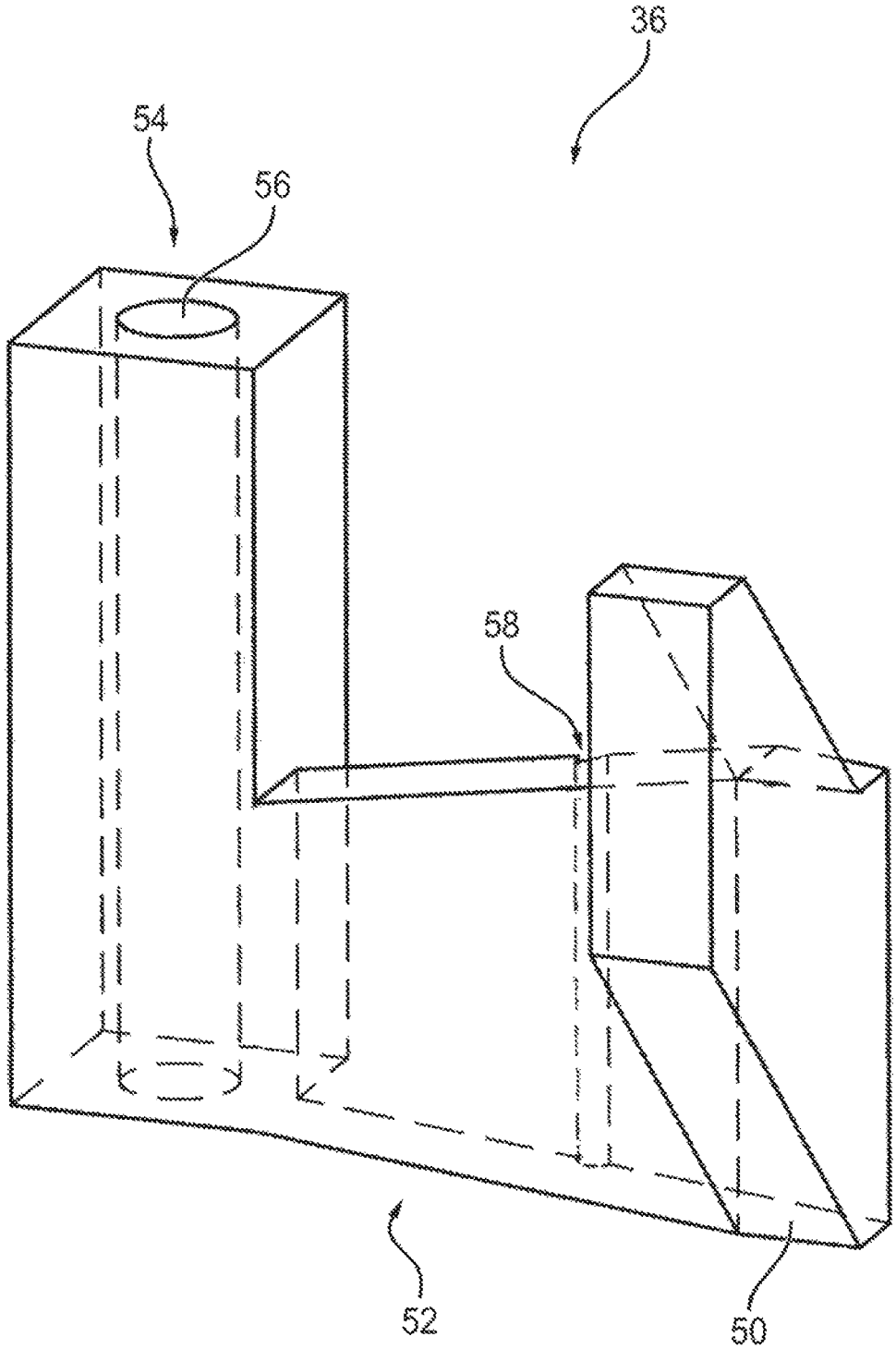
FIG. 5 shows a perspective schematic view of a contact tab of the rod according to FIG. 4.

FIG. 5 shows a perspective schematic view of the contact tab 36 according to FIG. 4. The contact tab 36 comprises the inclined contact surface 50 on an arm 52 and a mounting device 54. By means of the mounting device 54, the contact tab 36 is connected to the rod 34 in a rotationally fixed manner, for example by clamps. For this, the contact tab 36 comprises suitable means, in the embodiment a bore 56 having a diameter that results in a press-fit between rod 34 and contact tab 36. Further, a groove 58 for receiving an end of the torsion spring 40 is provided.

The entire disclosure of European Patent Application No. 13 151 453.1, filed Jan. 16, 2013, is expressly incorporated by reference herein.

What is claimed is:

1. A device for filling a thin-walled transport container made of flexible material with notes of value, comprising:

a supply unit for supplying the notes of value, a stacking unit for stacking the notes of value, a receiving unit for receiving the thin-walled transport container, a stuffing unit for transporting the stacked notes of value into the thin-walled transport container in several successive filling steps, and a closing unit disposed in said receiving unit for closing the thin-walled transport container in a revision-proof manner, the closing unit including a first subunit and a second subunit, wherein the receiving unit includes a contact sensor which, upon contact with a bottom of the thin-walled transport container, generates a signal, and wherein, dependent on said signal, the first subunit and second subunit of the closing unit cooperate to close the thin-walled transport container in a revision-proof manner, wherein the contact sensor comprises a rod which is rotatably mounted about its longitudinal axis, wherein the rod has a first rotary position in which the contact sensor generates no signal and wherein the rod has a second rotary position in which the contact sensor generates the signal.

2. The device according to claim 1, wherein the closing unit closes the thin-walled transport container by one of welding or bonding.

3. The device according to claim 1, wherein the thin-walled transport container is made of a foil material.

4. The device according to claim 1, wherein the notes of value are stacked so that their surfaces are oriented approximately parallel to the bottom of the thin-walled transport container.

5. The device according to claim 1, wherein said signal is generated by an interruption of a light beam.

6. The device according to claim 1, wherein said stuffing unit moves the stacked notes of value in said thin-walled transport container and an additional stacked notes of value, successively supplied from said stacking unit, further into the thin-walled transport container toward the bottom of the thin-walled transport container.

7. A device for filling a thin-walled transport container made of flexible material with notes of value, comprising:

a supply unit for supplying the notes of value, a stacking unit for stacking the notes of value, a receiving unit for receiving the thin-walled transport container, a stuffing unit for transporting the stacked notes of value into the thin-walled transport container in several successive filling steps, and a closing unit for closing the thin-walled transport container, wherein the receiving unit includes a contact sensor which, upon contact with a bottom of the thin-walled transport container, generates a signal and wherein, dependent on said signal the closing unit closes the thin-walled transport container, wherein the contact sensor comprises a rod which is rotatably mounted about its longitudinal axis, wherein the rod has a first rotary position in which the contact sensor generates no signal and wherein the rod has a second rotary position in which the contact sensor generates the signal.

8. The device according to claim 7, wherein the rod has a contact tab at its first rod end, which contact tab, upon contact with the thin-walled transport container, rotates the rod from the first into the second rotary position, and wherein the rod has a switching flag at its second rod end, which switching flag triggers the signal generation in the second rotary position.

9. The device according to claim 8, wherein the rod is rotated into the first rotary position by a torsion spring and is rotatable into the second rotary position against resistance of the torsion spring.

10. The device according to claim 9, wherein the thin-walled transport container is closed after a final filling step following signal generation.

11. The device according to claim 9, wherein the torsion spring exerts a torque on the rod, which rotates the rod into the first rotary position.

12. The device according to claim 11, wherein the torque is chosen such that the rod is rotatable into the second rotary position against said torque when said thin-walled transport container and said contact tab come into contact.

13. The device according to claim 8, wherein the thin-walled transport container is closed after a final filling step following signal generation.

14. The device according to claim 7, wherein the rod is rotated into the first rotary position by a torsion spring and is rotatable into the second rotary position against resistance of the torsion spring.

15. The device according to claim 14, wherein the thin-walled transport container is closed after a final filling step following signal generation.

16. The device according to claim 14, wherein the torsion spring exerts a torque on the rod, which rotates the rod into the first rotary position.

17. The device according to claim 16, wherein the torque is chosen such that the rod is rotatable into the second rotary position against said torque when said thin-walled transport container and said contact tab come into contact.

18. The device according to claim 7, wherein the thin-walled transport container is closed after a final filling step following signal generation.

* * * * *